US006887110B2

(12) United States Patent
Karir

(10) Patent No.: US 6,887,110 B2
(45) Date of Patent: May 3, 2005

(54) HIGH-DENSITY MULTI-PORT RJ CONNECTOR

(75) Inventor: Arvind Karir, Toronto (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 10/615,037

(22) Filed: Jul. 9, 2003

(65) Prior Publication Data

US 2005/0009408 A1 Jan. 13, 2005

(51) Int. Cl.[7] ..... H01R 24/00
(52) U.S. Cl. ..... 439/676
(58) Field of Search ..... 439/660, 676, 439/217–224, 692, 697

(56) References Cited

U.S. PATENT DOCUMENTS 5,244,402 A * 9/1993 Pasterchick et al. ..... 439/217
5,415,570 A * 5/1995 Sarkissian ..... 439/676
5,531,612 A 7/1996 Goodall et al.
5,639,267 A 6/1997 Loudermilk
5,647,043 A 7/1997 Anderson et al.
5,775,946 A 7/1998 Briones
6,099,349 A 8/2000 Boutros
6,244,896 B1 6/2001 Boutros
6,478,472 B1 11/2002 Anderson et al.

* cited by examiner

*Primary Examiner*—J. F. Duverne
(74) *Attorney, Agent, or Firm*—Blank Rome LLP

(57) ABSTRACT

The present invention is directed to a modular jack or RJ connector incorporated into a multi-port arrangement for use as an input/output interface connector for computers and the like. The multi-port connector comprises a single housing having a plurality of openings therein. Each opening is formed to provide at least two connecting ports to receive two corresponding plugs therein. Thus, the opening is formed without a dividing wall separating the two connecting ports. The removal of the dividing wall allows more connecting ports to be incorporated into the multi-port connector without increasing the size of its footprint.

6 Claims, 2 Drawing Sheets

HIGH-DENSITY MULTI-PORT RJ CONNECTOR

FIELD OF THE INVENTION

This invention relates to the field of electrical connectors, and in particular, to an arrangement for providing multiple input/output ports on a printed circuit board or interface card having increased ports without increasing the length or footprint of the assembly, yielding higher port density.

BACKGROUND OF THE INVENTION

Electrical connectors known as modular phone receptacles or jacks have been available for many years. Although connectors of this type were originally designed for use in telephone systems, they have found wide acceptance in a variety of other contexts. For example, modular jacks referred to as RJ connectors, which may be incorporated into single port or multi-port arrangements, are now commonly used as input/output (I/O) interface connectors for enabling computers to communicate with each other and with a variety of peripheral equipment, and in particular as connectors between a local area network (LAN) and an appropriately configured interface card.

In order to receive a corresponding modular plug, the conventional modular jack or RJ connector is generally made up of a socket housing which includes a plug-receiving opening, opposed top and bottom surfaces joined by opposed side surfaces extending from the opening to a back surface, and a plurality of stamped, metallic elongated contacts mounted in the housing for engaging contacts of the corresponding plug. Each contact in this type of connector includes a contact mating portion at one end extending diagonally into the socket, a vertically extending lead portion at the other end, and a horizontally extending intermediate portion between the contact mating portion and the lead portion. Generally, the lead portions of the contacts are inserted directly into openings in the interface card and soldered in place.

In order to reduce the cost and space requirements, these modular jacks have been integrated in a single housing in a juxtaposed manner for mounting onto a PC board as shown in FIG. 1. Due to the high data transmission speed of many computers today, such multi-port modular jacks are also provided with shielding around the external surface of the integral housing. It is also an advantage to have a large number of modular jacks mounted to the edge of a same printed circuit board, however increasing the number of parts would lengthen the connector assembly in the prior art solution shown in FIG. 1, as the modular jacks are arranged in a single row. The connector assembly length however is limited by the external size of the computer and the length of the printed circuit board to which it is mounted. It would therefore be desirable to increase the number of ports without increasing the length of the connector. In doing so, one should ensure that the resilient latches of the modular plugs that connect with the jacks are easily accessible in order to easily release the plug from the jack. Certain data transmission standards such as 10 Base T, require connector assemblies to function reliably for very high data transmission speeds and also high voltages. High data transmission speeds e.g. 100 Mhz require effective shielding, and high voltages mean that the signal contacts should be sufficiently spaced from the grounding circuits in order to avoid flashover.

U.S. Pat. No. 5,775,946 to Briones, which is incorporated herein by reference, discloses a shielded multi-port connector having a row of ports capable of receiving RJ-type connector plugs. The connector disclosed in this patent uses a single molded housing having multiple jack openings and a one-piece external shield in order to increase port density without significantly increasing assembly costs.

Another solution to increase port density, with minimal increase in the footprint of the assembly, is disclosed in U.S. Pat. Nos. 6,099,349 and 6,244,896, both to Boutros, which are incorporated herein by reference. These patents discloses a connector arrangement made up of two discrete rows multi-port connectors, each with an external shield, that are vertically stacked. The first connector is a conventional single row multi-port connector (FIG. 1); and the second connector is a single row multi-port connector with a vertical extension that houses a single row of contact tails that fits behind the first multi-port connector when the second connector sits on top of the first connector.

U.S. Pat. No. 5,531,612 to Goodall et al., which is incorporated herein by reference, discloses a multi-port connector having two rows of jacks that are assembled to a common integral housing and disposed in back-to-back mirror image symmetry. Shielding is provided around the connector assembly and between the two rows.

The prior art multi-port connectors contain walls dividing the individual jack openings, effectively providing one opening to one port configuration. These walls take up valuable space. Despite of the advances of the prior art, there remains a need to further increase the port density of a multi-port connector assembly without increasing the length or footprint of the assembly.

SUMMARY OF THE INVENTION

It is therefore an object of this invention to provide a multi-port modular jack assembly for mounting on a printed circuit board, with an increased number of ports without increasing the length of the assembly.

It is a further object of this invention to provide a multi-port modular jack assembly for mounting on a printed circuit board that is able to function reliably with systems operating under high data transmission rates and high voltages.

It is a further object of this invention to provide a compact and relatively inexpensive modular jack assembly with good access for latching and unlatching of complementary modular plugs for connection therewith.

The objects of the present invention can be accomplished by providing a multi-port connector having at least one opening. The at least one opening is designed to accommodate at least two plugs therein. Effectively, each opening provides at least two connecting ports.

In an embodiment of the invention, each opening has and internal shield to provide an EMI cage around each port.

DETAILED DESCRIPTION OF THE PREFERRED EMBODIMENTS

Figure 1:
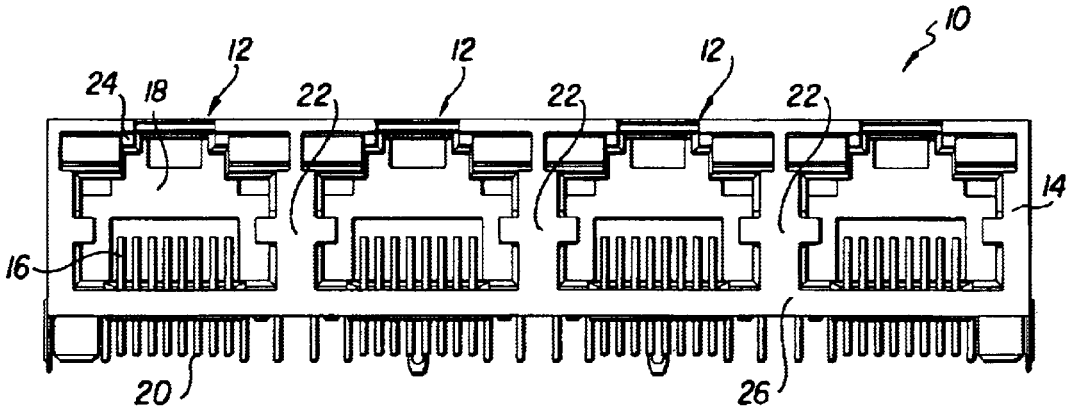
FIG. 1 (PRIOR ART)
FIG. 1 shows a typical prior art multi-port connector.

Referring first to FIG. 1, a prior art multi-port connector assembly is shown at 10 comprising a single row of juxtaposed modular jack connectors 12, such as RJ connectors, mounted in an integral main housing 14. Each modular jack connector 12 comprises a plurality of juxtaposed flexible spring wire contacts 16 for making electrical contact with a complementary modular jack inserted into an opening 18 of the modular jack connector 12, whereby the contacts 16 are integrally linked to printed circuit board pin portions 20 extending below the bottom of the connector assembly 10. Each modular jack connector 12 are separated from adjacent jack connectors 12 with walls 22 that physically separate the jack connectors 12.

The modular jack connectors 12 further comprise a latching protrusion 24 cooperable with resilient latching arms of the complementary modular plug for securely locking the modular plug thereto. The modular plug is disconnected from the modular jack connector 12 by elastically biasing the latching arm thereof inwards and pulling the plug out. The front face 26 of the connector assembly 10 is positioned proximate an outer surface of a computer within which the printed circuit board is mounted, so that access to the modular jack connectors 12 is possible from the exterior and the latching means easily accessible by hand. Effectively, each opening 18 of the prior art multi-port connector assembly 10 can only accommodates a single plug.

Realizing that the walls 22 of the prior art multi-port connector assembly 10 takes up valuable space, the present invention proposes removal of some of the walls to acquire space for additional connectors without increasing the length or footprint of the multi-port connector assembly.

Figure 2:
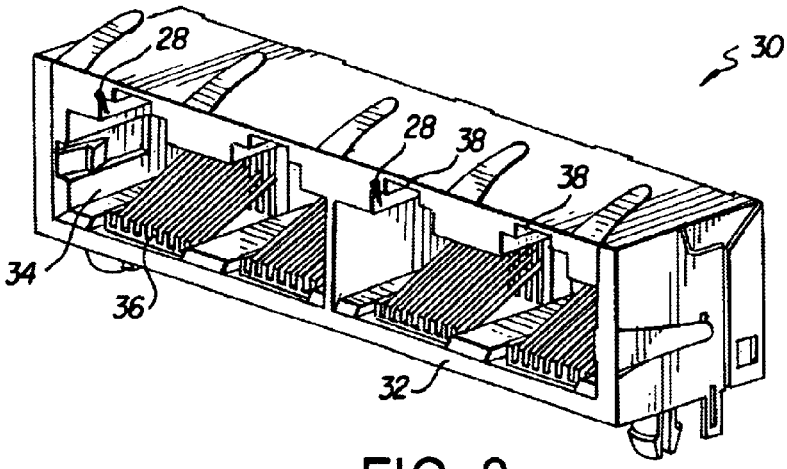
FIG. 2 shows an embodiment of the present invention having two ports per opening.

FIG. 2 shows an embodiment of the present invention where some of the walls of the prior art are removed. Four jack connectors 28, preferably RJ connectors, are shown in FIG. 2, however, any number of connectors is appropriate for the present invention. The front face 32 of the multi-port connector 30 contains a plurality of openings 34 for receiving modular plugs therein. As illustrated in FIG. 2, each opening 34 contains two jack connectors 28 which accommodate two plugs; however, more jack connectors 28 can be incorporated into a single opening to accommodate more than two plugs can also be appropriate depending on the design of the multi-port connector 30.

In the case illustrated in FIG. 2, each opening contains two sets of flexible spring wire contacts 36, with each set of spring wire contacts 36 making electrical contact with a corresponding plug. Like the prior art, contacts 36 are integrally linked to printed circuit board pin portions extending below the bottom of the connector assembly 30. Instead of having walls separating adjacent jack connectors, the present multi-port connector 30 allows for side by side location of the plugs. Importantly, for guiding the plug into connector, the present multi-port connector has guiding surfaces 38 locating at the top and bottom of the jack connector. These guiding surfaces 38 allows the plug to mate properly with the jack connector without requiring assistance of walls diving the individual jack connectors. Each jack connector 28 of the present invention is also provided with a latch protrusion 40 similar to that of the prior art to secure the plug to the connector.

Figure 3:
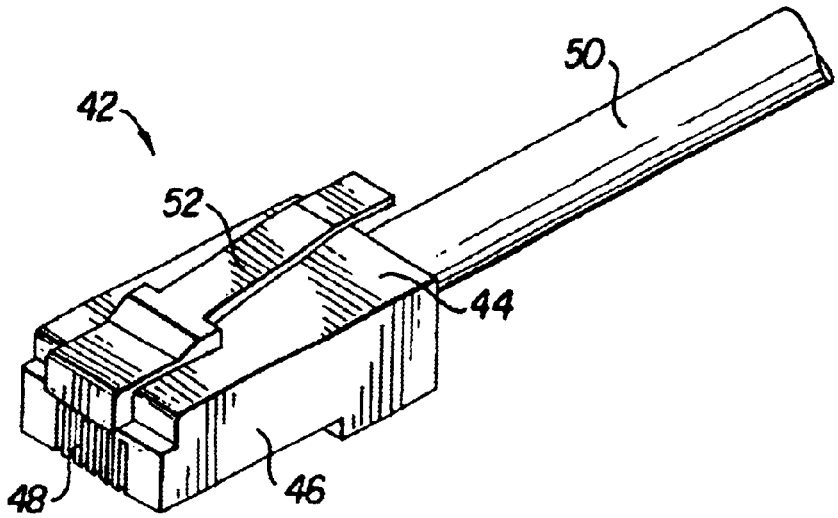
FIG. 3 shows a plug for use with the present invention.

FIG. 3 shows a modular plug 42 for use with the multi-port connector 30. The modular plug 42 comprises a housing 44 designed to fit into the openings 34 of the multi-port connector 30. The housing 44 contains slide surfaces 46 that slides along the guide surfaces 38 of the multi-port connector 30 to guide the modular plug 42 into the jack connector 28. Electrical contacts located within recesses 48 of the housing 44 make contact with the spring wire contacts 36 of the jack connector 28 to form an electrical connection between the plug and the jack connector. The electrical contacts are electrically connected to a cable 50 extending from the rear of the housing 44. On top of the modular plug 42 is a resilient latching arm 52 that cooperates with the latch protrusion 40 to secure to the modular plug 42 in the jack connector 28. In its natural position, the resilient latching arm 52 locks with the latch protrusion 40 to lock the plug in place. To disconnect the modular plug 42 from the jack connector 28, the resilient latching arm 52 is elastically biased toward the housing 44; and the modular plug 42 is pulled out.

In a further embodiment of the present invention, EMI shielding may be provided with the multi-port connector. Methods of shielding multi-port connectors, such as that of U.S. Pat. No. 5,775,946 to Briones, which is incorporated herein by reference, are known in the art and are applicable with the present invention. Typically, an external shield, such as that of U.S. Pat. No. 5,775,946, surrounding the multi-port connectors assembly is effective to shield the assembly from nearly electronic equipment. However, under certain circumstances shielding may be desirable between individual jack connector 28 to prevent cross talks. In such case, a shield may be inserted between the two jack connectors 28.

Figure 4:
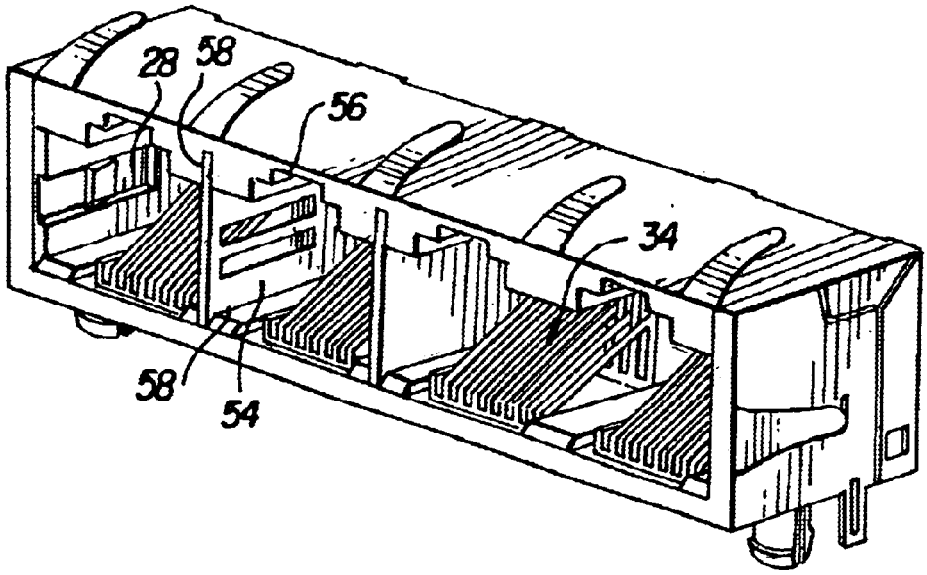
FIG. 4 depicts an embodiment of the present invention having internal shields.

FIG. 4 shows an embodiment of the present invention where EMI shielding between adjacent jack connectors 28 can be effected. Here, an internal metal shield 54 is inserted vertically between the two jack connectors 28. Preferably, the internal shield 54 slides into groves 58 cut into the top and bottom walls of the opening 34. The groves 58 preferably provide a tight fit to effectively hold the internal shield 54 in place. To provide an EMI cage around each port, the internal shield is preferably electrically connected to the external shield. In a preferred embodiment, the internal shield 54 further includes ground tabs 56 to accommodate shielded plugs. The ground tabs 56 electrically connect the shield of the plug to that of the jack connector.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A multi-port connector comprising a plurality of openings, each of said plurality of openings being bounded by a top and bottom wall and two side walls and each of said plurality of openings being capable of receiving at least two jack connectors therein concurrently.

2. The multi-port connector of claim 1, wherein each of said at least two jack connectors has a set of flexible spring wire contacts for forming electrical connections with electrical contacts on a plug.

3. The multi-port connector of claim 1, wherein each of said at least two jack connectors has a latch protrusion for locking with a resilient latching arm on a plug.

4. The multi-port connector of claim 1, wherein each of said at least two jack connectors has guiding surfaces for guiding the plug into proper mating position.

5. The multi-port connector of claim 1, further comprising an internal shield between the at least two jack connectors.

6. The multi-port connector of claim 1, wherein said at least two jack connectors are RJ connectors.

* * * * *

UNITED STATES PATENT AND TRADEMARK OFFICE

CERTIFICATE OF CORRECTION

PATENT NO. : 6,887,110 B2 
APPLICATION NO. : 10/615037
DATED : May 3, 2005
INVENTOR(S) : Arvind Karir It is certified that error appears in the above-identified patent and that said Letters Patent is hereby corrected as shown below:

Column 2,
Line 9, change “discloses” to --disclose--;
Line 27, delete “of” after “Despite”;
Line 50, change “and” to --an--.

Column 3,
Line 9, change “are” to --is--;
Line 24, delete “can”;
Line 26, change “takes” to --take--;
Line 52, delete “locating”;
Line 53, change “allows” to --allow--.

Column 4,
Lines 29 and 30, change “groves” to --grooves--.

Signed and Sealed this

Twenty-sixth Day of December, 2006

JON W. DUDAS
*Director of the United States Patent and Trademark Office*